United States Patent [19]

Morris

[11] 4,425,826

[45] * Jan. 17, 1984

[54] TOOL FOR REMOVING LIDS FROM TINS

[76] Inventor: Albert E. Morris, 64 Kuroki St., Penshurst, New South Wales 2222, Australia

[ * ] Notice: The portion of the term of this patent subsequent to May 4, 1999 has been disclaimed.

[21] Appl. No.: 253,113

[22] Filed: Apr. 10, 1981

Related U.S. Application Data

[63] Continuation-in-part of Ser. No. 63,322, Aug. 2, 1979, Pat. No. 4,327,607.

[51] Int. Cl.[3] ..... B67B 7/00; B25F 1/00

[52] U.S. Cl. ..... 81/3.36; 81/3.46 R; 81/425 R

[58] Field of Search ..... 81/3.34, 3.36, 3.46 R, 81/3.46 A, 5.1 R, 346, 364, 381, 383.5, 415, 418, 419, 425 R, 425 A, 426; 7/125, 126, 151, 165; 145/46

[56] References Cited

U.S. PATENT DOCUMENTS

| | | | |
|---|---|---|---|
| 367,843 | 8/1887 | Pierce | 81/417 X |
| 571,287 | 11/1896 | Ryder | 81/364 X |
| 768,832 | 8/1904 | Van Horn | 81/426 X |
| 902,570 | 11/1908 | Ellis | 81/381 |
| 1,490,019 | 4/1924 | Neumaier | 81/5.1 R X |
| 2,248,166 | 7/1941 | Eilers | 81/3.46 R |
| 2,700,910 | 2/1955 | Van Niel | 81/5.1 R |
| 3,946,453 | 3/1976 | Torres | 81/418 X |
| 4,327,607 | 5/1982 | Morris | 81/425 R X |

FOREIGN PATENT DOCUMENTS 862468 3/1961 United Kingdom .

*Primary Examiner*—James G. Smith
*Assistant Examiner*—Robert P. Olslewski
*Attorney, Agent, or Firm*—Nilsson, Robbins, Dalgarn, Berliner, Carson & Wurst

[57] ABSTRACT

A gripping tool has first and second displaceably connected members having respective associated jaws. The jaw of the first member is dimensioned to engage the upstanding flange under the peripheral lip of a tin lid such as is found on a tin of paint and for this purpose the jaw is preferably of thin flat strip-like form. The jaw associated with the second member is L-shaped and dimensioned so as to project beyond the end of the first member's jaw and downwardly so as to engage over the peripheral lip of the tin lid and down over an adjacent upstanding flange of the lid. The arrangement is such that when the handles are moved in a gripping action, the jaws clamp the upstanding flange of the tin lid to permit the lid to be removed from the tin without distortion of the lid.

3 Claims, 12 Drawing Figures

TOOL FOR REMOVING LIDS FROM TINS

STATUS OF THE INVENTION

This is a continuation-in-part of Ser. No. 63 322 of Albert E. Morris entitled 'Tool for Removing Lid from Tins' filed Aug. 2, 1979, now U.S. Pat. No. 4,327,607, issued May 4, 1982.

FIELD OF THE INVENTION

The present invention relates to a gripping tool particularly suitable for removing a lid from a tin, the lid having an annular peripheral lip projecting from an upstanding flange.

BACKGROUND TO THE INVENTION

Generally the tip of a screwdriver or a similar tool is used for removing the lid from a tin, the tool being inserted under the lip of the lid and a levering action is used against the top edge of the tin. However, when any appreciable resistance to removal of the lid occurs, for example due to solidified paint, then there is a tendency for such levering to cause a deformation of the lid. This not only makes subsequent removal of the lid more difficult, but may also prevent proper closure of the tin when the lid is re-applied.

The problem becomes more acute with tins having lids of the type that have been introduced in recent years, particularly for larger sizes such as the 5 liter. With such tins, the lid when fitted in the factory is in tight sealing relationship with the tin and is resistant to unintentional removal for example under vibration and impact. This type of tin has a rim at the upper end which is turned over and downwardly to provide an inwardly projecting annular shelf below the height at the top of the rim, which then extends to a U shaped groove projecting downwardly relative to the axis of the tin. The lid of the tin similarly has a generally U shaped edge portion for engaging in the U shaped groove, and a laterally extending annular flange which is adapted essentially to seat against the shelf portion to limit the extent to which the lid is pressed onto the tine.

OBJECT OF THE INVENTION

The present invention is directed to providing a gripping tool which can permit easy and safe removal of the lids from tins with little or no distortion or damage being caused to the tin or the lid.

More particularly the present invention is concerned with a gripping tool having first and second members which are relatively displaceably interconnected and have respective jaw elements at one end for gripping the tin lid.

SUMMARY OF THE INVENTION

The present invention provides a gripping tool for removing from a tin a lid having an annular peripheral lip projecting from an upstanding flange, the gripping tool comprising first and second members pivotally interconnected and having respective jaw elements at one end and characterized by the first member having its jaw element shaped and dimensioned for insertion under the lip of the lid and tapering to a flat tip of screw-driver-like form; and the second member having its jaw element being generally L-shaped and comprising a first part and a second terminal part, the first part being shaped and dimensioned for extending over the lip of the lid and the second terminal part being formed and dimensioned to extend down along and in contact with the flange of the lid and beyond the extreme end of said screwdriver tip for gripping the lid when the tool is closed; the spacing of the tip of the jaw element of the first member and the opposite face of the second terminal part of the second member decreasing steadily during closure so that, when said tool is in a closed position, the tip of the jaw element of the first member co-operates with the second terminal part of the second member to trap therebetween said upstanding lid flange whereby removal pressure may be exerted on said lid without distortion of said annular peripheral lip.

The L-shaped nose, which extends over the peripheral lip and the adjoining flange of the lid, serves to reinforce these parts of the lid and resist deformation thereof during loosening and removal of the lid.

Even when the invention is embodied in a tool of simple form, for example simply comprising two pivotally connected members, with some forms of tin it may be possible to at least partially loosen the lid of the tin simply by squeezing together the handles of the tool, although more generally, after having gripped the tool it will be necessary to exert a slight levering action with a bottom surface of the first member resting on the rim at the top edge of the tin which acts as a fulcrum.

With some forms of tin lid, in order to minimise deformation of the lid, it will be necessary to partially loosen the lid progressively at several points around its circumference before it is finally lifted off.

In one advantageous embodiment of the tool, the pivoting axis of the two members is off-set from the longitudinal median of the first member and extends through a protrusion provided on the first member on the same side as the face of the end portion intended to contact the lip of a lid to be removed.

The end portions of each member may conveniently have a width of 4 mm to 12 mm, preferably about 8 mm. The end portion of the first member may advantageously taper from a maximum thickness of about 3 mm to a flat edge facilitating insertion under the lip of a lid, and the terminal portion of the second member may likewise be tapered.

In a preferred form of the invention, the end portions of the respective members preferably co-operate so that if fully closed without being engaged over a tin lid, the tip of the end portion of the first member engages under the end portion of the second member. Furthermore, when the end member is generally L-shaped an included angle of about 113° is provided between the respective arms of the L-shape. More generally the angle may preferably be in the range of 110° to 115°.

One preferred embodiments provide for automatic removal of the lid by squeezing the handles, without need to exert any levering action. For this purpose a third member which exerts a force against the rim of the tin may be provided.

BRIEF DESCRIPTION OF THE DRAWINGS

Embodiments of the invention will now be given for the purpose of exemplification only with reference to the accompanying drawings, of which.

DETAILED DESCRIPTION OF THE DRAWINGS

Figure 1:
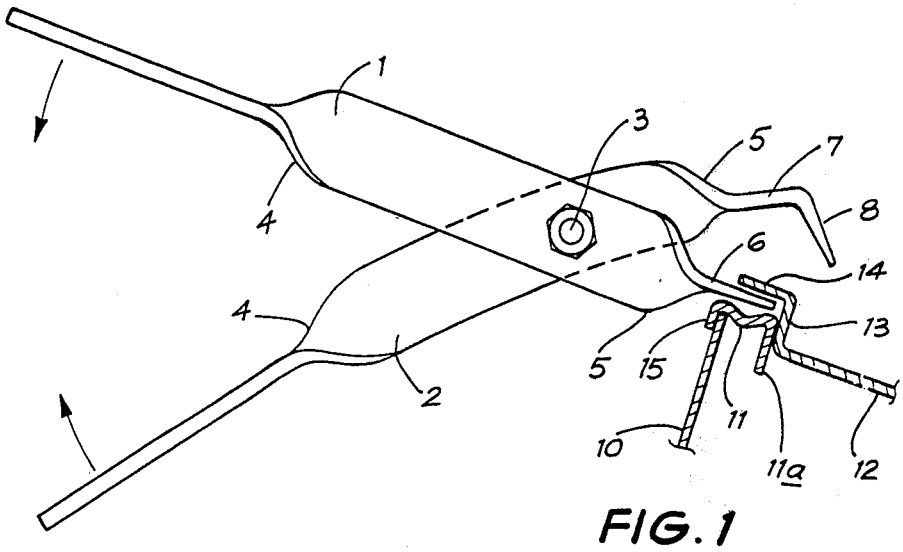
FIG. 1 shows a first embodiment of, gripping tool in side elevation in initial engagement with the lid of a tin shown partially and in cross-section.
Figure 2:
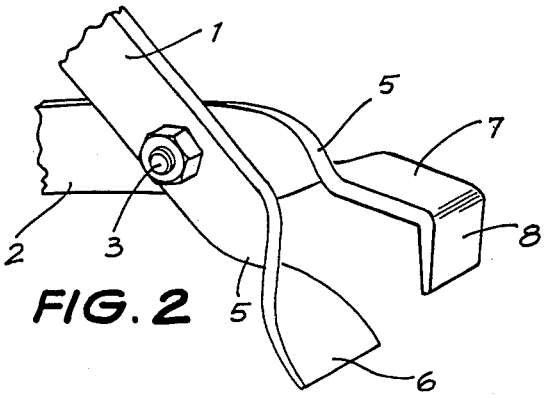
FIG. 2 is a partial perspective view of the tool of FIG. 1 in its open condition.
Figure 3:
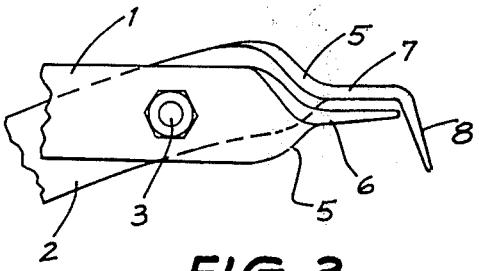
FIG. 3 is a side elevational view of the tool of FIG. 1 in its closed condition.

The gripping tool shown in FIGS. 1–3 is constructed in the manner of a pair of pincers or pliers with first and second members 1 and 2 pivoted together at 3 by a bolt or rivet. Each member is formed from a relatively thick strip of metal with a first twist 4 to provide a handle portion suitable for gripping. The nose of each member is formed with a second twist 5.

The nose 6 of the member 1 is thin, flat and tapered to an edge facilitating insertion under the peripheral lip 14 of a lid 12. The second member 2 has a generally L-shaped nose with a first portion 7 which lies parallel to the nose 6 when the tool is closed and a second, terminal portion 8 extending at about 113° to the portion 7. When the tool is closed as shown in FIG. 3 the tip of the nose 6 is against the top inside portion of the terminal portion 8 of the second member.

An example of one type of tin for which the tool is intended is shown partially in FIG. 1. The tin 10 has an inner annular shelf-like surface and a downwardly extending flange 11*a* extending from a rim 15 of the tin. The lid 12 has a corresponding outer annular lip 14 extending from an upstanding flange 13. When removing the lid 12 from the tin 10 with the illustrated tool, the flat nose 6 is inserted under the peripheral lip 14 of the lid 12. A subsequent squeezing together of the handle portions of the tool will cause engagement of the terminal portion 8 of the L-shaped nose over the flange 13.

The terminal portion 8 makes an angle of about 113° to the portion 7, so as to ensure that during closure of the tool the spacing of the tip of the nose 6 and the opposite face of the terminal portion 8 decreases steadily. This action causes the nose 6 to be driven further under the lip 14.

Finally, the upstanding flange 13 is trapped between the tip of the nose 6 and the terminal portion 8. Thus, pressure is exerted on the upstanding flange 13 of the lid rather than on the lip 14, so that distortion of the lip 14 during removal of the lid is avoided.

If the handle portions are now moved together downwardly, the nose 6 will pivot about the rim 15 of the tin 10 to lever the lid 12 away from the tin. In general, it is more satisfactory to apply the tool progressively at several locations around the circumference of the tin before the lid is fully released. Usually the flange 13 on the lid will be slightly tapered so that when the lid is fitted to the tin a wedging action occurs between the flange 13 of the lid and the flange 11*a* of the tin.

Figure 4:
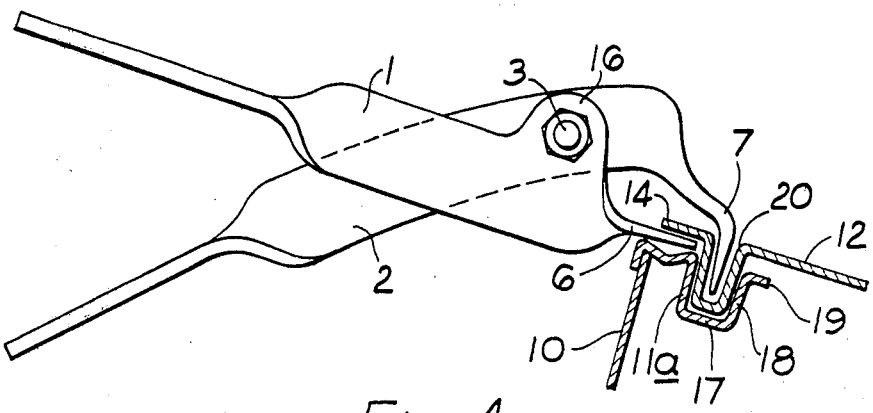
FIG. 4 is a view corresponding to FIG. 1 of a modified form of tool, the tool in this case being shown in an almost closed condition with a modified form of tin shown partially and in cross section.

A second tool is shown in FIG. 4 and is generally similar to the tool in FIG. 1, and only the differences will be highlighted, similar parts being given the same reference numerals. The tool of FIG. 4 has its pivot 3 off-set with respect to the member 1 and passing through a protrusion 16 provided on this member on the same side as the face of the nose 6 intended to contact the lip 14 of a lid. This arrangement has been found to give a more satisfactory levering action in certain applications.

As shown in FIG. 4 a second form of tin 10 is illustrated. In this case a slightly downwardly tapered groove 17 is formed adjacent to the opening to the tin, the outer wall of the annular groove 17 being formed by the flange 11*a* and the opposite wall being formed by wall 18 having an inwardly turned edge 19. The lid 12 has a corresponding shape with a similar U-shaped groove 20 formed between the central portion of the lid and the peripheral lip 14, the dimensions of the groove 20 being chosen in relation to the dimensions of the groove 17 to cause a wedging action, the walls of the respective grooves being slightly resilient. Usually such tins are designed so that a seal is established at several points.

Although the tools illustrated are made from strip metal, metal in rod form may also be used. Furthermore, the shape of the tool may be varied with respect to that illustrated in the drawings to render the tool more suitable for mass-production manufacturing techniques, e.g. stamping, pressing, casting, etc.

Typically, the gripping tool may be formed from mild steel strip of about 12 mm×2.5 mm in cross-section. The two end portions or noses may have a width of about 8 mm and preferably each taper to an edge. The terminal portion of the L-shaped nose may be 6 mm in length, and its distance from the pivot about 33 mm. According to the material used, these dimensions may be varied to achieve the desired strengths and to suit the manufacturing techniques employed.

It has been found that a desirable embodiment of the invention is one which can operate successfully on a wide range of tins having various profiles around the lid and the opening in which the lid fits. In this case, the jaws of the tool are substantially as shown in FIG. 3, with the axis of pivoting being approximately 25 to 30 mm from the end of the nose 6. Furthermore, the axis of pivoting is approximately 6 mm below a plane defining the upper edge of the nose 6 and the lower surface of the first portion 7.

Figure 5:
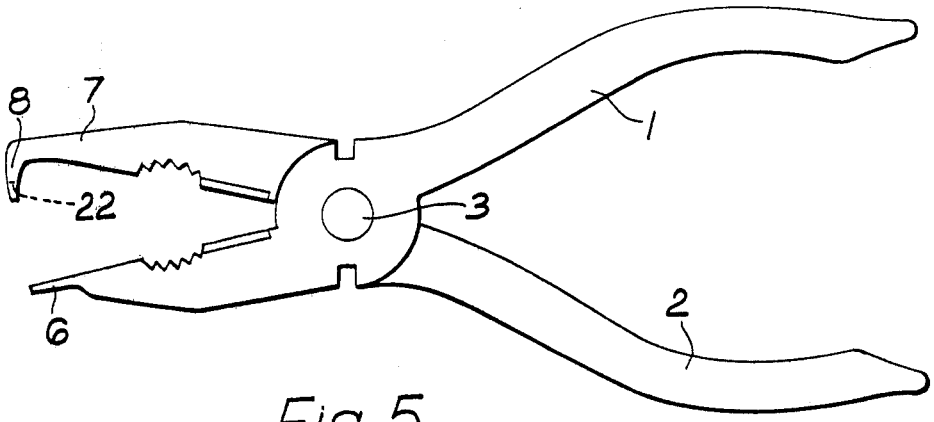
FIG. 5 is a side elevation of a third embodiment.

In the third embodiment of FIG. 5 the tool is a conventional pair of pliers but with a modified end to each of the jaws. The lower jaw has a flattened nose 6 and the upper jaw has an L-shaped end with a terminal portion 8 which co-operates with the flat nose 6 in the same manner as in the above described embodiment of the invention. This tool can be remarkably useful since a multiplicity of tasks can be carried out with the tool. Virtually all tasks normally performed by pliers can still be performed yet tins can also be opened by virtue of the shape of the jaws. A further advantageous feature which is provided is a V-shaped notch 22 provided in the terminal portion 8 of the upper jaw. This permits for example, a screw or bolt to be held with the threaded portion of the screw clamped between the V-shaped groove and the flat nose 6 and indeed the tip of the flat nose 6 could be used to engage in a screwdriver slot in the head of the screw.

Figure 6:
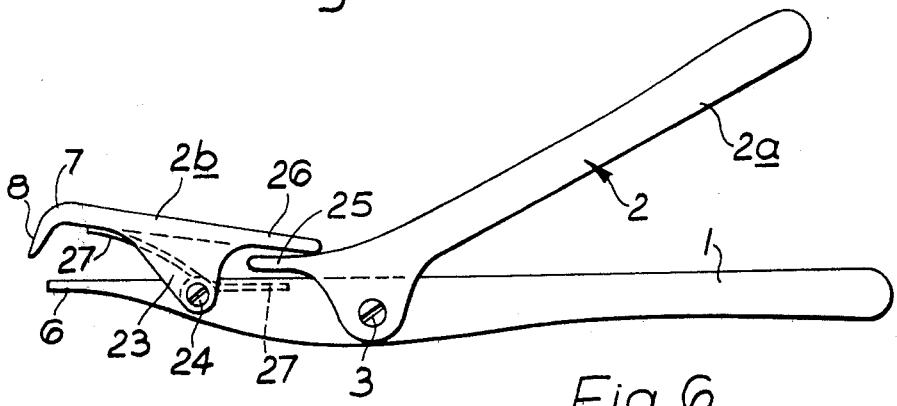
FIG. 6 is a side elevation of a fourth embodiment.

In the embodiment of FIG. 6, the "second member" constitutes a pivotal handle portion 2*a* and a separate pivotally mounted head portion 2*b* having a pair of lateral downwardly extending ears 23 bridging the first member 1 and being pivotally connected thereto by a rivet 24. A lug 25 extends forwardly of the handle 2*a* to engage under a rear tab 26 of the head portion 2*b*, a torsion spring 27 spring biasing the head portion 2*b* in a clock-wise direction as shown in FIG. 6 so that the rear tab 26 presses down on the lug 25 of the handle thereby spring biasing the tool to an open position. The tool functions essentially in the same way as the tools of the previous embodiments.

Figure 7:
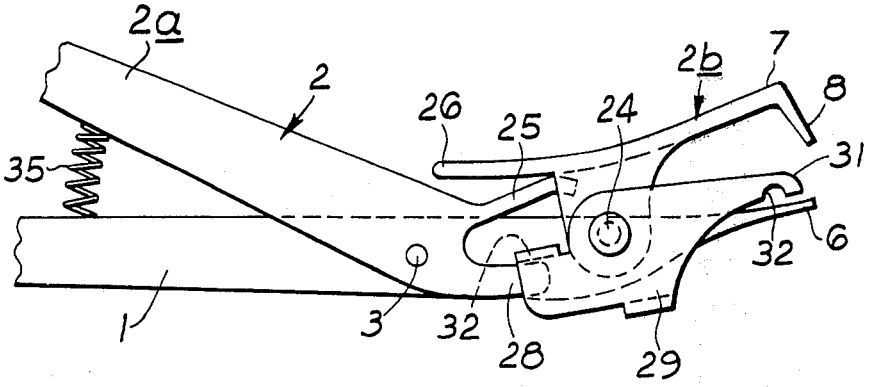
FIG. 7 is a side elevation of a fifth embodiment being a modification of the embodiment of FIG. 6 and having an additional lever arm.
Figure 8:
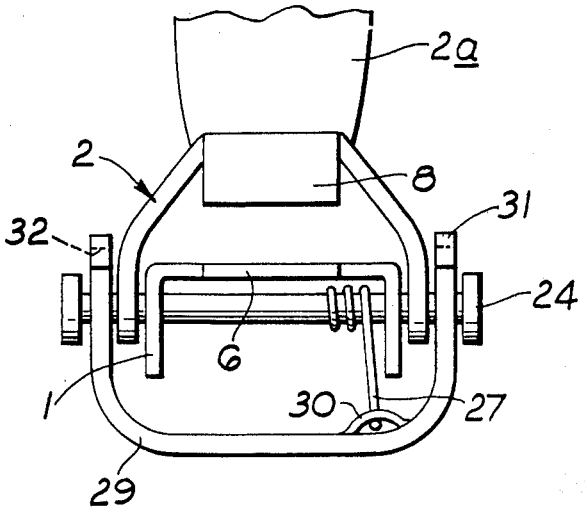
FIG. 8 is an end elevation from the right of the tool of FIG. 7.

Referring now to the embodiment of FIGS. 7 and 8, a tool similar to the embodiment of FIG. 6 is illustrated, and the same reference numerals have been used for similar parts.

In this embodiment the handle 2*a* has its lower end forked to form a pair of legs 28 located on each side of the handle 1 and operable to pivot a lever arm 29 in a clock-wise direction when viewed as in FIG. 7 relative to the first member 1 when the tool is gripped and moved to closed position. The arm 29 is biased to the position as shown in FIG. 7 by a torsion spring 27 which is partially shown in FIG. 8. One end of the spring engages in an interior lug 30 on the inside of the lever arm 29, the body of the spring extends around the secondary pivot shaft 24 and the rear of the spring which cannot be seen in the drawing extends through an apperture in the top of the handle 1 to lie in abuttment with the interior of the handle 2 in the region of its abuttment with the lug 26. Thus this spring urges the handles and the lever arm 29 into the position shown in FIG. 7.

As best seen from FIG. 8 of the lever arm 29 is U-shaped in end view with arms 31 projecting forwardly and having respective notches 32 for engaging on the edge of the rim of a tin.

FIG. 8 also shows that the handles 1 and 2 are both generally U-shaped.

When the tool is to be used, the nose 6 is inserted under the peripheral lip of the tin lid and this results in the notch 32 in each arm 31 being positioned over the edge of the rim of the tin. When the handles are squeezed together, the lugs 28 of the handle 2*a* engage under corresponding inwardly turned lugs 33 at the rear of the lever arm 29 to rotate the lever arm clock-wise relative to the handle 1 thereby bringing the notches 32 into engagement with the rim; simultaneously the lug 25 engages under the rear tab 26 to rotate the head portion 2*b* clock-wise and continued motion causes engagement of the jaws of the tool over the tin lid with the nose 6 being lifted upwardly relative to the arms 31 so that the tin lid is forced upwardly without the user exerting any leverage. A helical compression spring 35 fixed to the handle 1 acts to return the handle 2 towards its position shown in FIG. 7 upon release.

Figure 9:
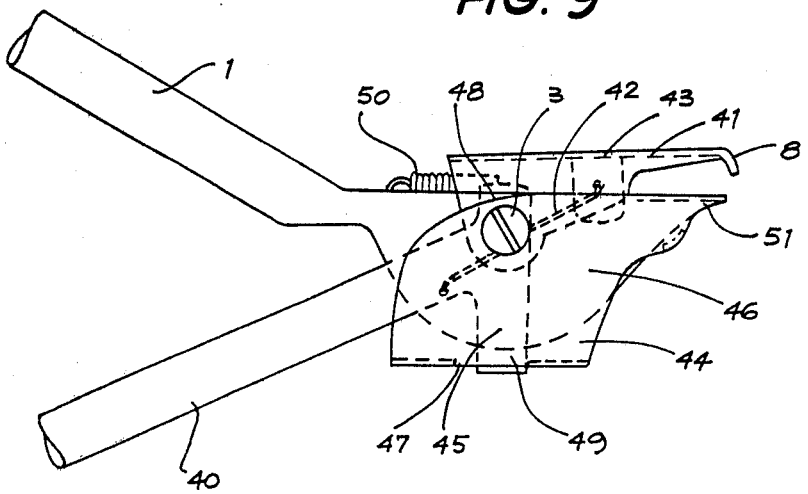
FIG. 9 is a side elevation of a sixth embodiment in an open position.
Figure 10:
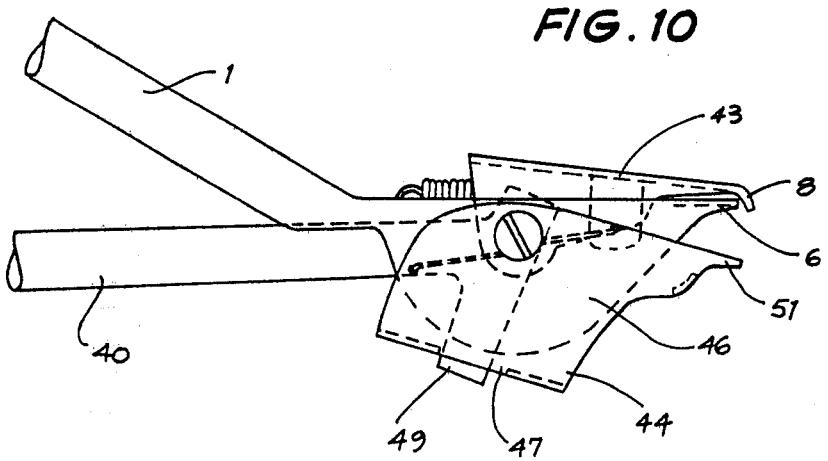
FIG. 10 is the sixth embodiment in a closed position.

FIGS. 9 and 10 show a sixth embodiment which has the additional feature that continued squeezing of the handles, after the tips of the jaw have engaged the upstanding flange 13, causes downward movement of a further member thereby lifting the lid from the tin. It is not necessary to lever the lid off using downward movement of both handles together in this embodiment.

Thus, the second member is composed of two portions, a handle portion 40 and a beak portion 41 which are pivoted together at bolt 3 and spring loaded by a spring 42. The spring 42 extends around bolt 3, one end of the spring engages handle 40 and the other end is attached to a lug 43 welded to the inside of nose portion 41. During the first phase of closure of the tool beak portion 41 moves in response to movement of handle 40 until terminal portion 8 engages nose portion 6 of the first member 1.

A further outer member 44 is freely pivoted at bolt 3 and has two prongs 51 which lie one at each side of nose 6. In order from inside to outside the following elements are pivoted on bolt 3, the one lying inside the succeeding element, viz: spring 42, a head 45 of handle portion 40, beak portion 41, a split central portion 46 of first member 1, and finally outer member 44.

Handle 40 is provided with a head 45 having an upper end 48 and a lower arm 49. Upper end 48 is spring loaded to member 1 by a return spring 50 tending to return handle 40 and member 1 to the open position. Lower arm 49 is slideably engaged in a slot 47 provided in the base of outer member 44.

The tool is operated as follows. Nose 6 and prongs 51 are inserted under the lid with beak 41 passing over lip 14. During a first phase as member 1 and handle 40 are squeezed together, beak portion 41 moves in response to movement of handle 40 until upstanding flange 13 is trapped between terminal portion 8 and nose portion 6. Outer member 44 is freely pivoted at 3 and does not move.

However, in a second phase, continued movement of handle 40 acts against spring 42 so that handle 40 moves whilst beak portion 42 remains stationary in contact with upstanding flange 13. As handle 40 is moved, lower arm 49 of the head 45 slides along slot 47 until it abuts the left hand end (as viewed in FIG. 9), thereafter further movement of handle 40 causes outer member 44 to pivot in a clockwise direction (as viewed in FIG. 9) so that prongs 51 move downwardly away from nose portion 6.

The lid 12 is held between nose portion 6 and terminal portion 8. The downward movement of prongs 51 exerts a force against rim 15 of the tin and leads to separation of the lid from the tin. The final disposition of the tool is shown in FIG. 10.

Figure 11:
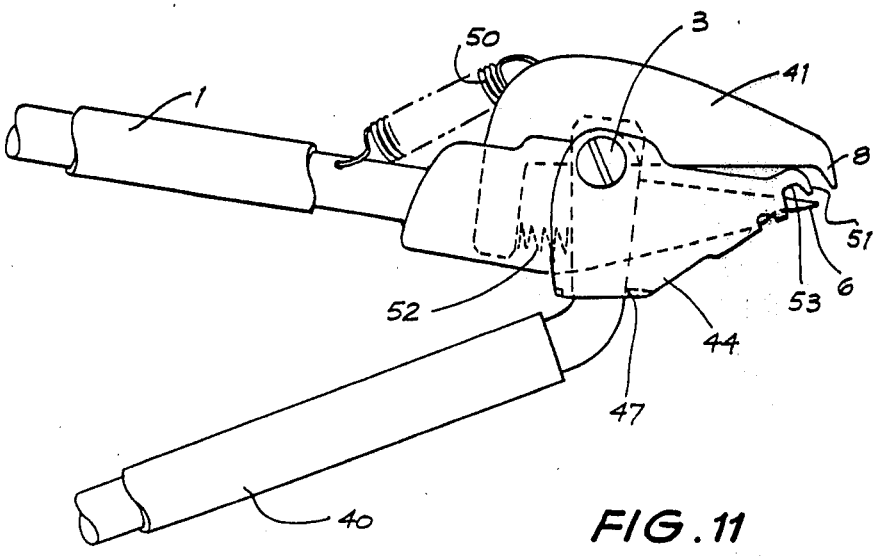
FIG. 11 is a side elevation of a seventh embodiment in an open position.
Figure 12:
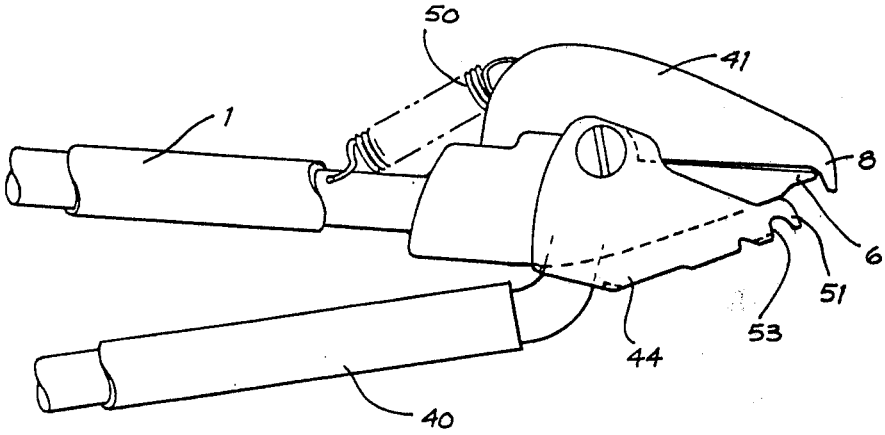
FIG. 12 is the seventh embodiment in a closed position.

FIGS. 11 and 12 show a seventh embodiment similar to that of FIG. 9. The principal points of difference are that the handle 40 is constructed as shown rather than with a head portion as in FIG. 9. Also, a compression spring 52 is provided between beak 41 and handle 40, in place of the spring 42 of FIG. 9. Furthermore, return spring 50 is operative between first member 1 and beak portion 41. Prongs 51 are provided with cutouts 53 which slip over the rim of the tin. Operation being similar to that of the embodiment of FIG. 9.

I claim:

1. A gripping tool for removing from a tin a lid having an annular peripheral lip projecting from an upstanding flange, the gripping tool comprising first and second members pivotally interconnected and having respective jaw elements at one end and characterized by the first member having its jaw element shaped and dimensioned for insertion under the lip of the lid and tapering to a flat tip of screw-driver-like form; and the second member having its jaw element being generally L-shaped and comprising a first part and a second terminal part, the first part being shaped and dimensioned for extending over the lip of the lid and the second terminal part being formed and dimensioned to extend down along and in contact with the flange of the lid and beyond the extreme end of said screwdriver tip for gripping the lid when the tool is closed; the spacing of the tip of the jaw element of the first member and the opposite face of the second terminal part of the second member decreasing steadily during closure so that, when said tool is in a closed position, the tip of the jaw element of the first member co-operates with the second terminal part of the second member to trap therebetween said upstanding lid flange whereby removal pressure may be exerted on said lid without distortion of said annular peripheral lip;

said second member comprising separate handle and beak portions pivotally mounted on a common pivot with said first member;

the tool further comprising a third member pivotally mounted on said common pivot, having at least one forward projecting prong lying adjacent said screwdriver tip, and being provided with an abutment;

an arm being comprised in said handle portion and being disposed and dimensioned for contacting said abutment and rotate said third member;

the tool being operative so that as said first member and said handle are squeezed together, in a first phase of closure said upstanding flange is trapped as aforesaid, and in a second phase of closure said arm contacts said abutments so as to rotate said third member exerting force on the rim of the tin and removing the lid from the tin.

2. A gripping tool according to claim 1, wherein the arm of said handle portion is bend outwardly from the remainder of the handle portion, and said handle portion is pivotally mounted on said common pivot at the bend.

3. A gripping tool according to claim 1, wherein the arm of said handle portion is bent outwardly from the remainder of the handle portion, and said handle portion is pivotally mounted on said common pivot at the free end of said arm.

* * * * *